US005158865A

United States Patent [19]

Harder et al.

[11] Patent Number: 5,158,865

[45] Date of Patent: Oct. 27, 1992

[54] PHOTOGRAPHIC ELEMENTS CONTAINING REMOVABLE FILTER DYE

[75] Inventors: John W. Harder, Rochester, N.Y.; Peter R. Seoane, Coatesville, Pa.; Michael P. Youngblood, Rochester, N.Y.

[73] Assignee: Eastman Kodak Company, Rochester, N.Y.

[21] Appl. No.: 633,651

[22] Filed: Dec. 20, 1990

[51] Int. Cl.[5] ..... G03K 1/84

[52] U.S. Cl. ..... 430/513; 430/507; 430/510; 430/512; 430/517; 430/543; 430/559

[58] Field of Search ..... 430/507, 510, 512, 513, 430/517, 519, 559, 561, 958, 959, 543, 549, 558, 562, 563

[56] References Cited

U.S. PATENT DOCUMENTS

| | | | |
|---|---|---|---|
| 4,358,525 | 11/1982 | Mooberry et al. | 430/217 |
| 4,363,865 | 12/1982 | Reczek et al. | 430/223 |
| 4,482,629 | 11/1984 | Nakagawa et al. | 430/542 |
| 4,500,636 | 2/1985 | Ono et al. | 430/566 |
| 4,684,604 | 8/1987 | Harder | 430/375 |
| 4,923,789 | 5/1990 | Yagihara et al. | 430/517 |
| 5,026,628 | 6/1991 | Begley et al. | 430/512 |

FOREIGN PATENT DOCUMENTS 0280252 8/1988 European Pat. Off. .

*Primary Examiner*—Hoa Van Le

*Attorney, Agent, or Firm*—Joshua G. Levitt

[57] ABSTRACT

Novel photographic filter dyes are immobile as incorporated in a photographic element, but during processing, are uniformly converted to a form which is removable from the element. The filter dye is represented by the structure:

DYE—LS—BAL where:

BAL is a ballast group;

DYE is a filter dye moiety;

LS is a splittable linking group attached to a position in DYE that is not in conjugation with the dye chromophore.

11 Claims, No Drawings

PHOTOGRAPHIC ELEMENTS CONTAINING REMOVABLE FILTER DYE

This invention relates to novel photographic filter dyes and to photographic elements containing them. In a particular aspect it relates to color photographic materials, in particular reversal materials in which true color rendition is desired, in which the filter dye is readily removed during processing.

Color images are commonly formed by a reaction between oxidized silver halide developing agent and a dye forming compound called a coupler. The coupler commonly is incorporated in the photographic element, although in some high quality materials, such as those sold under the trademark Kodachrome, they can be contained in the processing solutions and introduced into the element during processing after exposure. Oxidized silver halide developing agent which reacts with the coupler to form a dye is the product of development of reducible silver halide. Silver halide can be rendered reducible by exposure to actinic radiation, e.g. in a camera, to form a latent image. Upon contact with developing agent the latent image catalyzes the reaction between the silver halide and the developing agent to form elemental silver and oxidized developing agent. To form a color negative image, the developing agent is one whose oxidized form couples with the coupler to form a dye. This leads to a negative dye image, whose density values are inversely proportional to those of the original image. To form a reversal image (i.e. a positive image in the exposed material), the developing agent initially employed is one whose oxidized form will not couple to form a dye. A second development step is then performed, in which the silver halide which had not been reduced in the first step is reacted with a developing agent whose oxidized form will couple. This leads to a dye image whose density values are directly proportional to those of the original image.

Color photographic elements commonly comprise layers sensitive to the three primary regions of the spectrum (i.e., blue, green and red) in which are formed dye images whose spectral absorption (i.e. yellow, magenta and cyan) is complementary to the sensitivity of the layer with which they are associated. Since most silver halide grains are sensitive to the blue region of the spectrum, typically a yellow filter layer is positioned between the source of exposure and silver halide that is not intended to be exposed to blue radiation. Similarly, an overlying filter layer can be used to "trim" the spectral distribution of the light reaching a spectrally sensitized silver halide layer (e.g. a red sensitized or green sensitized layer), thus permitting the use of a spectral sensitizing dye having a broader spectral absorption than desired for the particular application. Optimally, the filter dye and sensitizing dye have absorption characteristics that results in maximum filtration with minimal loss of speed in the region of desired sensitivity.

In addition, filter dyes and layers can be incorporated in photographic: elements for other purposes; e.g. to prevent internal reflections in an emulsion layer and thus reduce image spread, or to reduce reflection from an underlying layer to an overlying layer.

The filter dye serves its function during exposure. Thus, it generally is not desired after the image is processed. With color negative materials, which are used as an intermediate in the formation of a positive image, the presence of the filter dye increases the amount of energy needed for exposure to make a print from the negative. In reversal products, the presence of the filter dye distorts the color of the image. Thus, it is desirable to decolorize or remove the filter dye after exposure. This typically is done during processing.

One way of decolorizing the filter dye has been to destroy the chromophore which provides color to the dye. A problem with this technique is that compounds which are very reactive (and thus are easily decolorized) generally have poor stability. On long term keeping of the unexposed element the filtering ability of such compounds changes, which can adversely affect speed and color reproduction.

If the filter dye is incorporated in the element by associating it with a mordant, it is possible during processing to modify the physical properties of the filter dye so that it does not associate as strongly with the mordant and thus can be removed from the element. One problem with using mordanted dyes is that if the force which binds the mordant and the dye is sufficiently strong to prevent the mordant from wandering during keeping prior to exposure, it becomes difficult to remove all of the dye in the time available during processing. On the other hand, if the mordanted dye is rapidly removable during processing, the bond between the dye and the mordant may be so weak that the dye may leave the mordant during keeping and wander through the layers of the element, causing unwanted filtration and a possible loss in sensitivity. Another problem with using a mordanted filter dye is that the mordant can bind extraneous materials during processing, such as sensitizing dyes, and developing agents. This will result in unwanted stain.

Accordingly, it would be desirable to provide filter dyes, and photographic elements containing them, in which the filter dye is retained in the location where it is coated during storage and exposure, yet is readily removed from the element during photographic processing.

This invention provides novel filter dyes and photographic elements containing them which solve this problem.

In accordance with this invention there is provided a photographic element comprising a support bearing a silver halide emulsion layer and an immobile filter dye having a ballast group which is removable from the remainder of the dye during processing at a pH of 10 to 12.

As used herein, the term "immobile" means that the dye will not wander through the layers of a photographic element under the pH and hydration conditions encountered during manufacture and storage. Removal of the ballast from the dye converts it from an immobile form to a form that is mobile in the element and can be removed therefrom in one of the processing baths. Conversion from the immobile form to the removable form can occur in the development step. Alternatively, the dye, and/or the processing steps, can be designed for conversion to occur in a subsequent step. Removal can occur in the same processing step as conversion, or in a separate, subsequent step. Conversion and removal can occur in one of the existing processing steps or one or both can occur in an additional step or steps added to the processing sequence specifically for that purpose.

Conversion of the dye to the removable form can involve reducing its bulk and/or increasing its solubility. This can be accomplished by the removal of a ballast group or the unblocking of a solubilizing group or both.

The product which results from the conversion reaction should remain in the removable form for at least as long as required to be removed from the element. Thereafter, the compound can stay in the converted form, revert to the original form, or go to a new form, depending upon the particular reactions involved.

Photographic elements have been described in which a blocking group is attached to a dye and is uniformly removable during processing. U.S. Pat. Nos. 4,358,525, 4,363,865, and 4,500,636 describe examples of such materials. However, the attachment of the blocking group is for the purpose of shifting the hue of an image dye so that it does not act as a filter. Also, in most cases, these materials are used in very high pH systems (e.g. pH13+).

DYES useful in this invention can be represented by the structure:

DYE—LS—BAL where:

DYE is a filter dye moiety;

LS is a splittable linking group attached to DYE; and

BAL is a ballast group.

DYE can include any filter dye moiety that has the desired color, is compatible with a photographic system and is of such size that it will readily be removed from the element during processing. Preferred classes of dyes include cyanines, merocyanines; azos. oxonols, arylidenes (e.g. merostyryls), azo, anthraquinones, triphenyl methanes, azo methines, and the like. Preferably the dye moiety is not otherwise reactive during processing. Representative filter dyes are well known in the art and are described in James, *The Theory of Photographic Process*, 4th, Macmillan, New York (1977) 194–234 Hamer *The Cyanine Dyes and Related Compounds*, Interscience (1964) and Colour Index 3d, The Society of Dyers and Colourists, Great Britain (1971).

The ballast group represented by BAL can be any group of sufficient size and bulk that, with the remainder of the molecule, renders the DYE moiety immobile prior to processing. It can be a relatively small group if the remainder of the group is relatively bulky. For example, if splitting of LS unmasks a solubilizing group, BAL need not be very bulky if the dye as a whole is immobile. When detached from DYE, the ballast moiety can be mobile and wash out of the element during processing or it can be immobile and remain in the element.

BAL is Joined to DYE via a splittable linking group that is attached to a position that is not in conjugation with the dye chromophere so that it does not change significantly the hue of the dye.

Splitting of the linking group, LS, typically occurs by a hydrolysis reaction which is initiated by a component of one of the processing solutions (e.g. an acid or a base). For the materials to be useful under the processing conditions to which the present elements are subjected, splitting should rapidly proceed at a pH in the range of pH 10-pH 12, especially at pH 10.6–11 where many reversal processes are carried out. The hydrolysis reaction can be assisted by a group on the DYE moiety, the ballast group and/or the linking group, or by a group which is a separate component of one of the processing compositions (e.g. a nucleophile).

An exemplary reaction is the hydrolysis of an ester. For example, an imidomethyl ester or a beta- or gamma-keto ester can be hydrolyzed in the presence of base and the reaction can be accelerated by the presence of a nucleophile, such as hydroxylamine. Similarly, acetal and ketal protecting groups can be hydrolyzed in the presence of acid. In other instances hydrolysis is preceded by a separate oxidation or reduction reaction, such as the oxidation of a hydrazide group or of a sulfonamidophenol. The reactions can be anchimerically assisted.

Representative reaction schemes are illustrated below. In these reactions the unsatisfied bond represents the point of attachment to the DYE, or to a group which is attached to the DYE, and R is a generalized representation of hydrogen or appropriate substituents. Typically, one of the R substituents will be the ballast group.

A) Hydrolysis of a phthalimidomethyl ester:

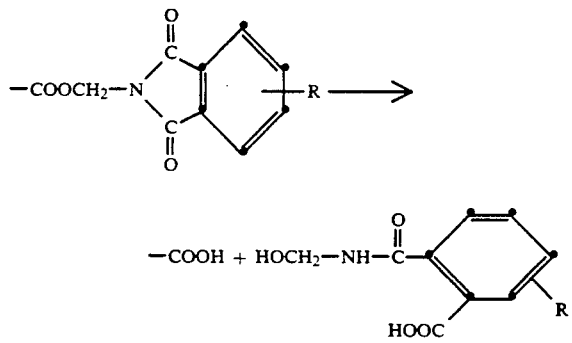

B) Hydrolysis of a keto ester:

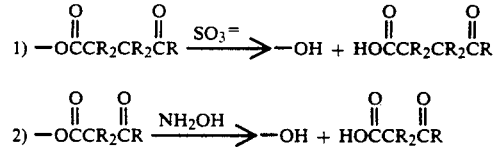

C) Oxidative cleavage of a diketone:

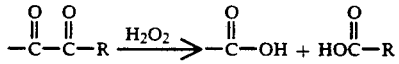

D) Hydrolysis of a ketal or acetal:

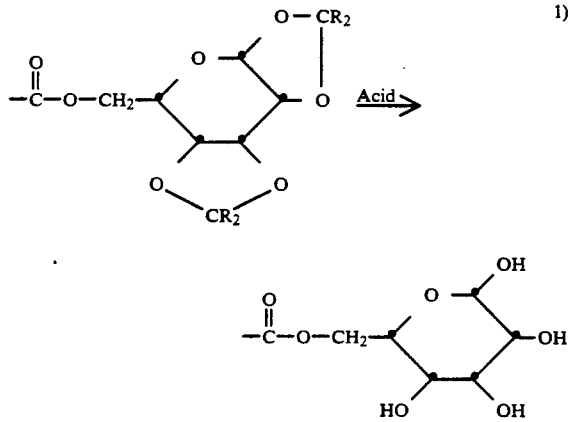

-continued

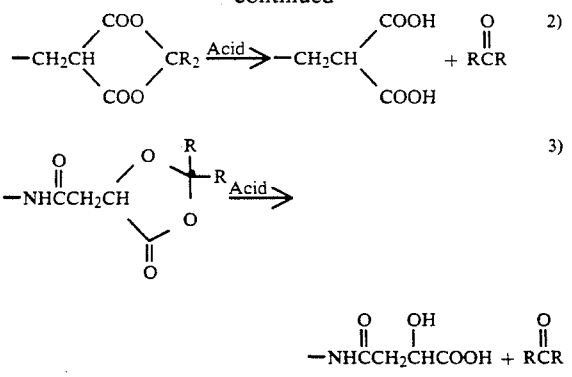

E) Hydrolysis following oxidation:

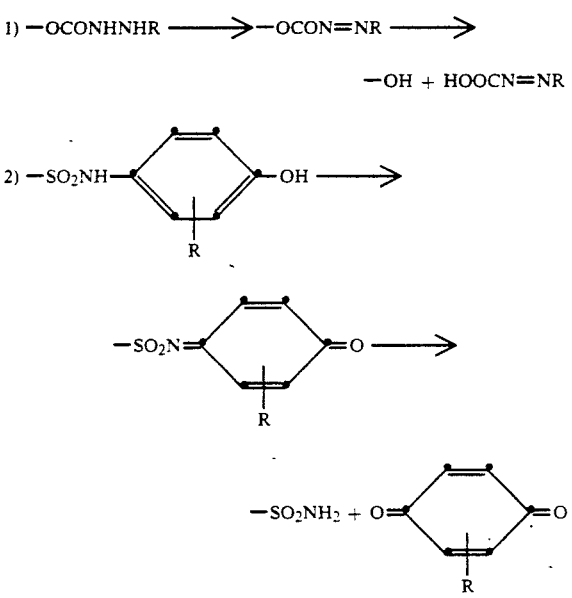

f) Fluoride-catalyzed siloxy bond cleavage:

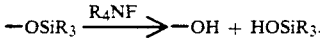

g) Anchimerically assisted base-catalyzed hydrolysis:

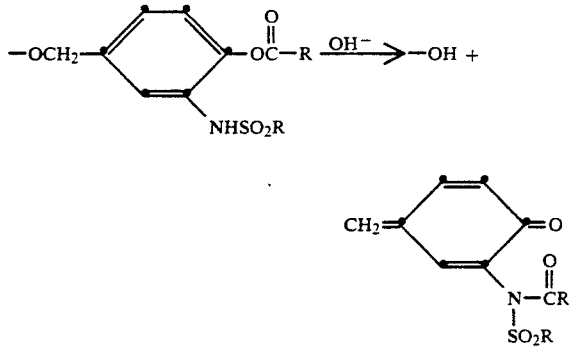

Preferred filter dyes of this invention can be represented by the structure:

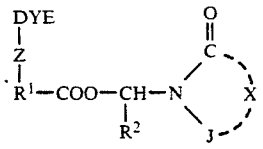

wherein:

DYE is as defined above;

Z is O, S or a nitrogen of a heterocyclic ring;

$R^1$ is alkylene of 1 to 10 carbon atoms or arylidene of 6 to 16 carbon atoms;

$R^2$ is hydrogen, alkyl of 1 to 4 carbon atoms or aryl of 6 to 12 carbon atoms;

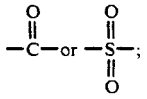

X represents the atoms to complete a 5- or 6-membered ring or ring system moiety.

Preferably Z is 0.

In the above structural formula the moiety X, together with the group represented by J, can complete a mono-, bi- or tri-cyclic ring or ring system each ring of which contains 5 to 6 members. A preferred ring system is the phthalimide (1,3-isoindolinedione) ring system. Other useful ring systems include saccharin, (1,2-benzisothiazolin-3-one-1,1-dioxide), succinimide, maleimide, hydantoin, 2,4-thiazolidinedione, hexahydro-2,4-pyrimidinedione, 1,4-dihydrophthalimide, and the like. These rings can be unsubstituted or substituted.

Especially preferred are filter dyes represented by the structures

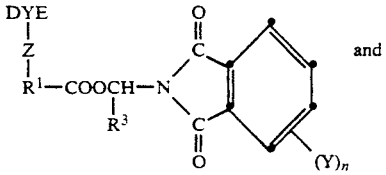

and

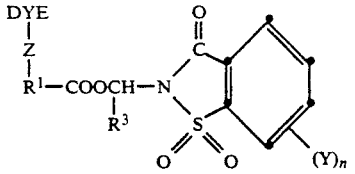

wherein

DYE, Z, and $R^1$ are as defined above;

$R^3$ is hydrogen or alkyl of 1 to 4 carbon atoms.

n is 0 to 3; and

Y is a substituent.

Suitable substituents include halogen, nitro, alkyl, aryl, alkenyl, alkoxy, aryloxy, alkenyloxy, alkylcarbonyl, arylcarbonyl, alkenylcarbonyl, alkylsulfonyl, arylsulfonyl, alkenylsulfonyl, amino, aminocarbonyl, aminosulfonyl, carboxy, alkoxycarbonyl, aryloxycarbonyl, alkenyloxycarbonyl and the like. The alkyl portions of these substituents contain from 1 to about 30 carbon atoms, the alkenyl portions of these substituents contain from 2 to about 30 carbon atoms, and the aryl portions of these substituents contain from 6 to about 30 carbon atoms. The alkyl, aryl and alkenyl portions of these substituents can be further substituted with groups of the type specified above. Thus, alkyl is inclusive of, e.g. aralkyl and aryloxyalkyl, aryl is inclusive of, e.g., alkaryl and alkoxyaryl.

Especially preferred are compounds in which either the dye, the ballast or both contain a polar group or ionizing group. Representative such groups include sulfonamido, amidosulfonyl, sulfonyl, sulfoxy, sulfamoyl, imido, carboxy, hydroxy, phosphonate, sulfonate, phenol and the like.

Representative filter dyes of this invention have the following structures:

1

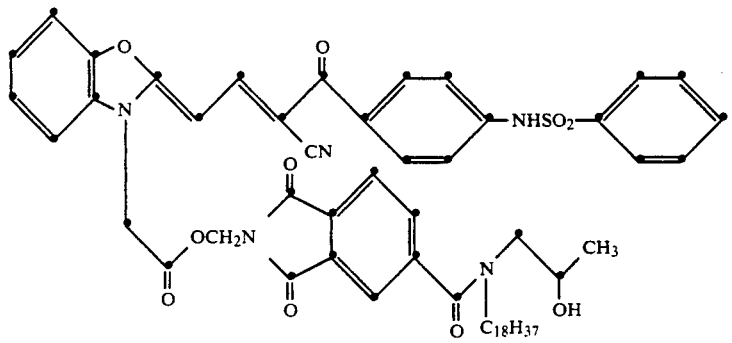

2

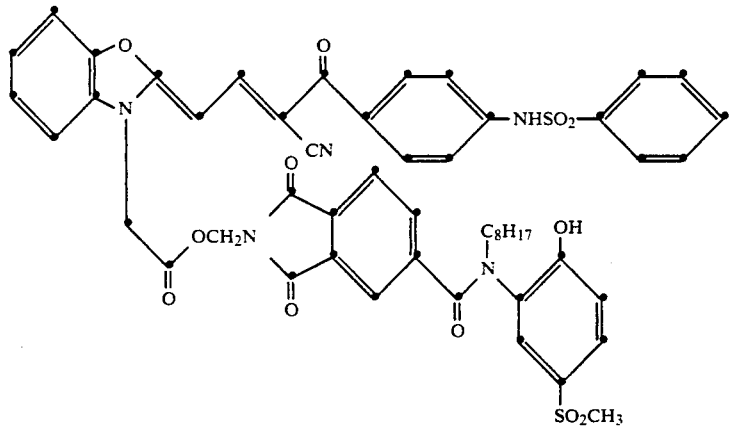

3

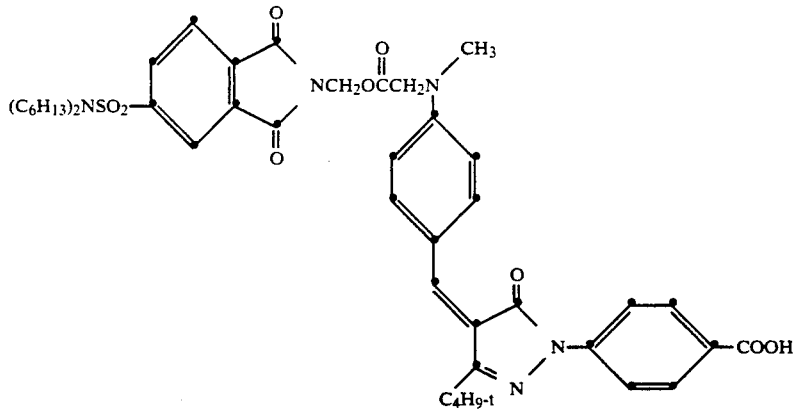

4

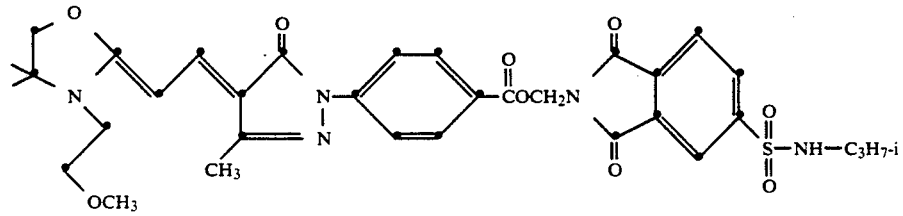

-continued
5
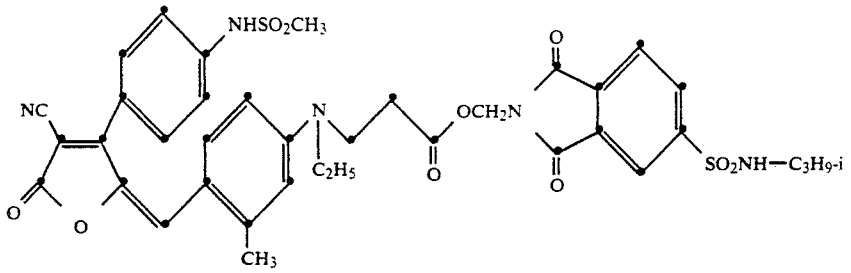
6
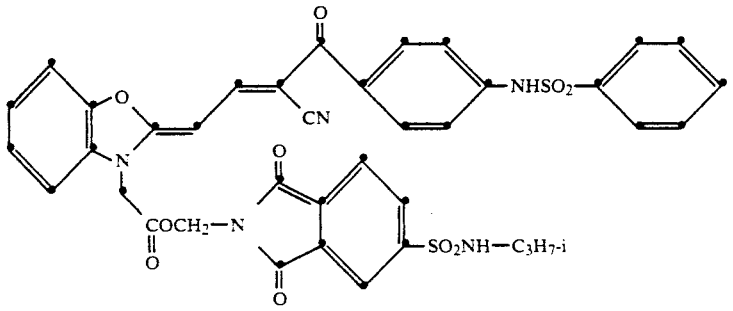
7
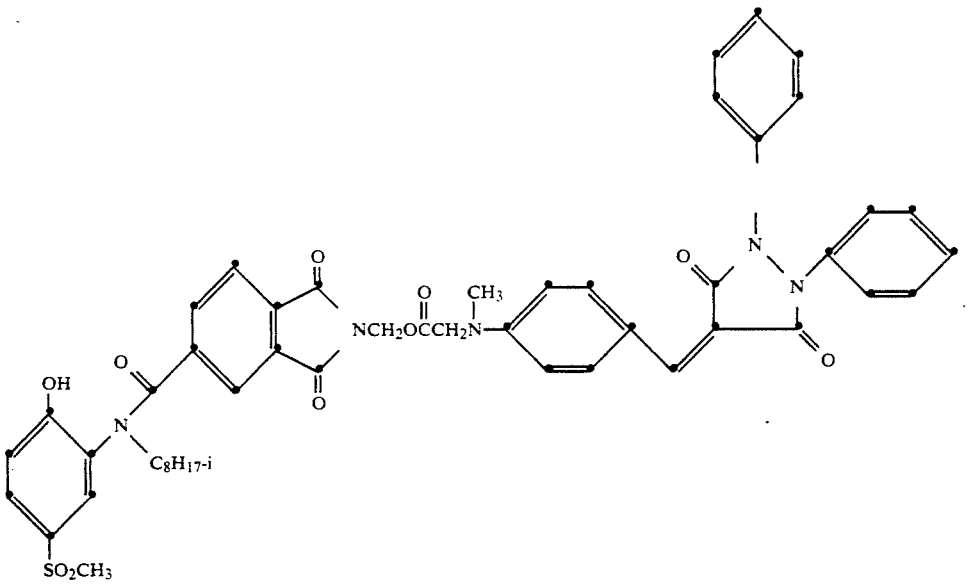
8
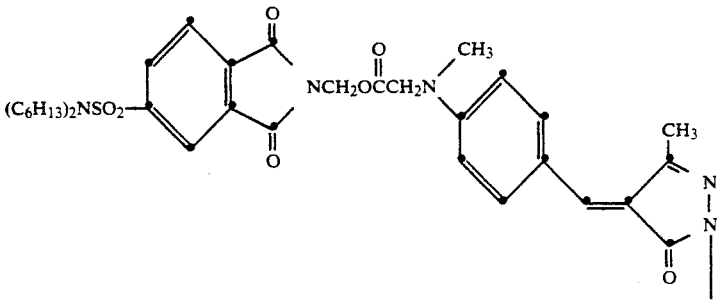

-continued

8

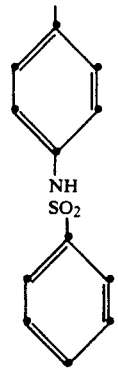

9

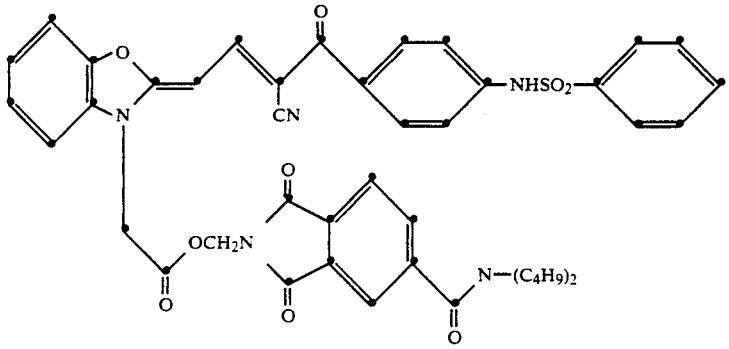

10

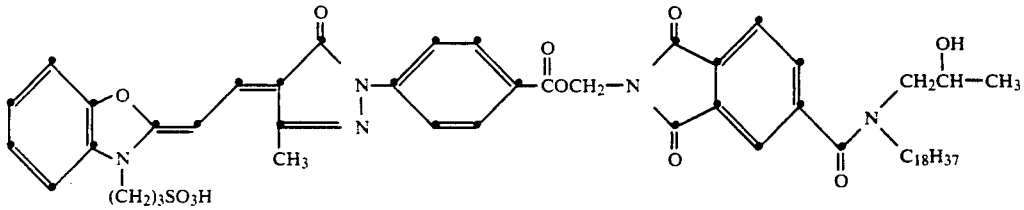

11

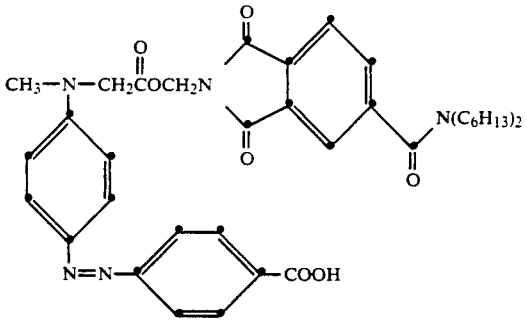

Filter dyes of this invention can be prepared by sequential stepwise reactions in which there is attached to a preformed DYE moiety the entire —LS—BAL group or the LS group followed by the BAL group. The Preparation of representative dyes shown in the synthesis example, infra, is illustrative of synthetic techniques that can be employed.

The immobile filter dyes of this invention can be used in the ways and for the purposes that filter dyes have been used in the art. They can be incorporated in a vehicle, such as gelatin, another hydrophilic polymer or a combination of such materials and coated as a separate layer in the photographic element in the desired location. As indicated above, this can be between, above or below an emulsion layer intended to be protected from radiation absorbed by the filter dye. In other embodiments of the invention, the filter dye is incorporated in a silver halide emulsion layer.

The amount of filter dye incorporated can vary widely, depending upon such factors as the location, the degree of filtration desired and the relative absorption of the dye. Typically, the dye can be incorporated in the element in an amount in the range of 0.001 to 2 $g/m^2$. A preferred range, when the dye is used to prevent radiation from reaching an underlying layer is 0.05 to 1.0 $g/m^2$. When the dye is used within a light sensitive layer to enhance sharpness by preventing light scattering, a preferred range is 0.01 to 0.5 $g/m^2$.

The photographic elements in which the filter dyes of this invention are employed can be either single color or multicolor elements. If they are single color elements (including black and white) the filter compound can be used to increase the sharpness of the image by absorbing radiation within a layer or in an underlayer.

Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow-dye forming coupler. The element contains additional layers, such as one or more filter layers of this invention, or other filter layers, interlayers, overcoat layers, subbing layers, and the like.

In the following discussion of suitable materials for use in the elements of this invention, reference will be made to *Research Disclosure,* December 1989, Item 308119, published by Kenneth Mason Publications, Ltd., The Old Harbourmaster's, 8 North Street, Emsworth, Hampshire PO10 7DD, ENGLAND, the disclosures of which are incorporated herein by reference. This publication will be identified hereafter by the term "*Research Disclosure.*"

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in U.S. Pat. Nos. 4,379,837, 4,444,877; 4,665,012; 4,686,178; 4,565,778; 4,728,602, 4,668,614; and 4,636,461; and published applications EP 264,954, GB 1,027,146; and JA 54/48,521. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure.* Section IV.

Suitable vehicles for the emulsion layers and other layers of elements of this invention are described in *Research Disclosure,* Section IX and the publications cited therein.

The multicolor elements of this invention typically include couplers as described in *Research Disclosure.* Section VII, paragraphs D, E, F and G and the publications cited therein. These couplers can be incorporated as described in *Research Disclosure.* Section VII, paragraph C and the publications cited therein.

The photographic elements of this invention can contain brighteners (*Research Disclosure.* Section V), antifoggants and stabilizers (*Research Disclosure.* Section VI), antistain agents and image dye stabilizers (*Research Disclosure,* Section VII, paragraphs I and J), light absorbing and scattering materials (*Research Disclosure,* Section VIII), hardeners (*Research Disclosure,* Section X), coating aids (*Research Disclosure,* Section XI) plasticizers and lubricants (*Research Disclosure,* Section XII), antistatic agents (*Research Disclosure,* Section XIII), matting agents (*Research Disclosure,* Section XVI) and development modifiers (*Research Disclosure.* Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluenesulfonic acid.

With negative working silver halide this processing step leads to a negative image. To obtain a positive (or reversal) image, this step is preceded by development with a non chromogenic developing agent to develop exposed silver halide, but not form dye, then uniform fogging of the element to render unexposed silver halide developable after which the remaining silver is developed with a color developing agent and the oxidized color developing agent reacts with coupler to form a dye. Alternatively, a direct positive emulsion can be employed to obtain a positive image.

Development is followed by the steps of bleaching, fixing, or bleach-fixing, to remove silver and silver halide, washing, and drying Typical bleach baths contain an oxidizing agent to convert elemental silver, formed during the development step, to silver halide. Suitable bleaching agents include ferricyanides, dichromates, ferric complexes of aminocarboxylic acids and persulfates.

Fixing baths contain a complexing agent that will solubilize the silver halide in the element and permit its removal from the element. Typical fixing agents include thiosulfates, bisulfites, and ethylenediamine tetraacetic acid.

In some cases the bleaching and fixing baths are combined in a bleach/fix bath.

Depending upon the particular filter dye employed, the specific composition of the processing solutions and the residence time of the element in the processing solutions, the filter dyes of this invention can be converted to the removable form and removed in one of the processing baths used to perform the conventional functions of development, bleaching, and fixing or bleach-/fixing. Alternatively, one or both of the conversion and removal steps can be performed in a separate solution. Typically this will be an aqueous alkaline solution, in which the element is placed for a time sufficient to convert and remove the filter dye. This step can be between other processing steps or after bleaching and fixing. The preferred solution for removal comprises an aqueous solution at a pH in the range of 10–12 such as the solutions used in reversal processing. Residence times in the solution of several seconds to several minutes, e.g. 30 seconds to 30 minutes are suitable. The length of time will depend on the composition of the solution and the particular dye being removed.

The following examples further illustrate this invention.

EXAMPLE 1

Synthesis of Filter Dye #9

Overall Reaction Scheme for Dye Moiety

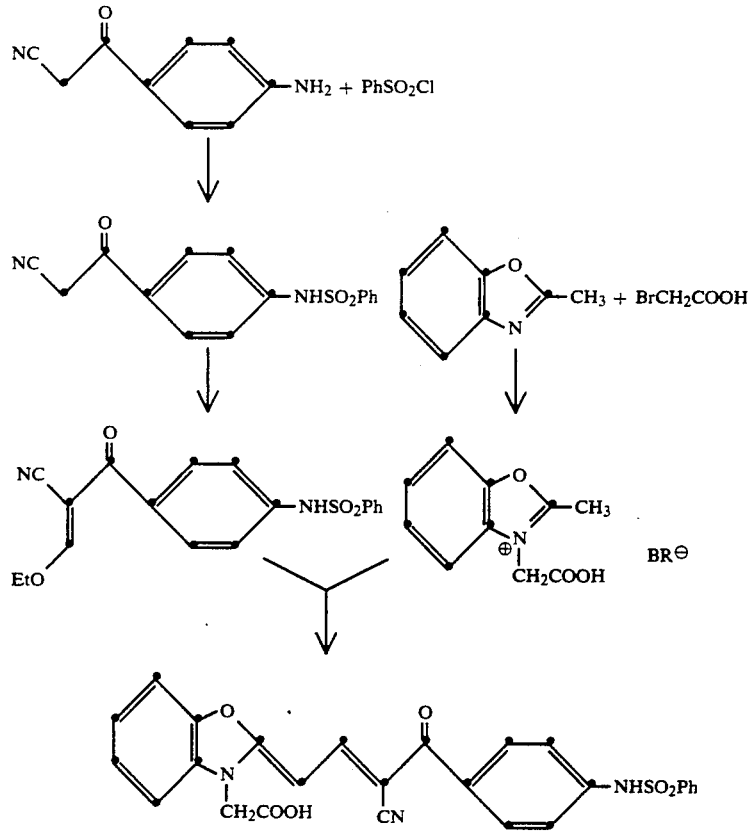

Step 1

-continued

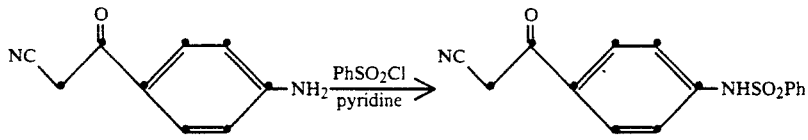

| | | |
|---|---|---|
| p-Aminobenzoylacetonitrile | MW = 160.177 | 80 g (0.5 moles) |
| Benzenesulfonyl chloride | MW = 176.62 | 88 g (0.5 moles) |
| Pyridine | | 150 mls |

Procedure p Aminobenzoylacetonitrile (80 g, 0.5 moles) was dissolved in 150 ml of pyridine and chilled with stirring to 0° C. Benzenesulfonyl chloride (88 g, 64 mls, 0.5 moles) was added dropwise over 1 hour, taking care due to the exothermic nature of the reaction. Once the addition was complete, the mixture was allowed to come to room temperature and stirred for 2 hours. The now tarry mixture was solubilized in a minimum amount of methanol and added dropwise to a stirred 1N HCl solution (2 liters) at 0° C. (the addition of some ice is helpful). The solid that is formed is collected by filtration and slurried in warm ethanol. Cooling of this slurry gave, after filtration, a reddish brown solid that was washed with diethyl ether. 90 g of the solid was obtained.

Step 2a

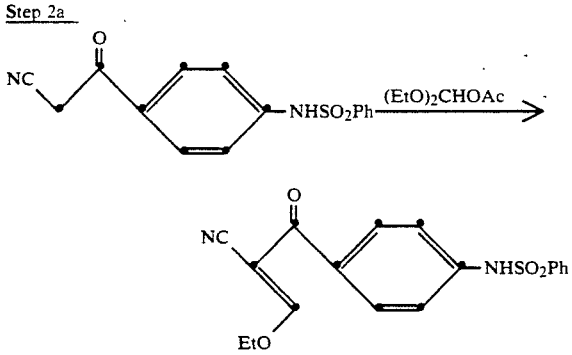

| | | |
|---|---|---|
| p-Benzenesulfonamido-benzoylacetonitrile | MW = 300 | 50 g (0.167 mol) |
| Diethoxymethylacetate | MW = 162.19 | 150 ml |

Procedure 50 grams of the benzoylacetonitrile is taken up in 150 ml (≠5 eq.) of diethoxymethylacetate. The reaction is allowed to stir overnight, then is extended with 350 ml of diethyl ether. The solid is collected by filtration, and the filter cake further washed with diethyl ether. The pale purple solid is allowed to air dry, yielding 52 g of product (>85%).

Step 2b

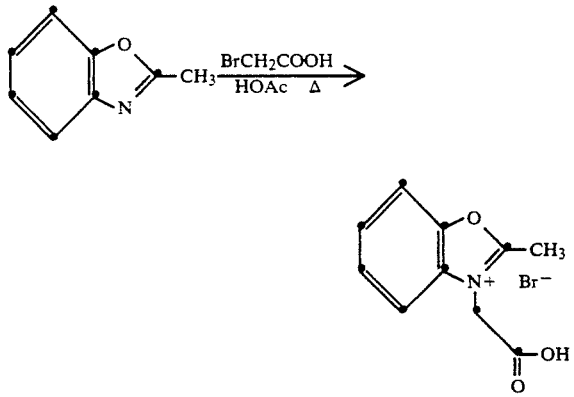

| | | |
|---|---|---|
| 2-Methylbenzoxazole | MW = 133.15 | 100 g (0.75 moles) |
| Bromoacetic Acid | MW = 138.95 | 100 g (0.72 moles) |
| Acetic Acid | | 250 mls |

Procedure

A 1 liter 3-neck flask is outfitted with a condenser and a mechanical stirrer. The reaction vessel is charged with 250 mls of glacial acetic acid, 100 grams of 2-methylbenzoxazole and 100 grams of bromoacetic acid. Bring the mixture to reflux under mechanical stirring. The originally clear solution will darken as the reaction proceeds until a strong coloration due to the presence of bromine in noted. As the reaction proceeds, a white crystalline solid will be deposited. After about 6 hours at reflux, discontinue the heating but maintain mechanical stirring. As the reaction mixture cools to room temperature, the deposition of product will continue. The crystals are collected by filtration, and washed with diethyl ether. The desired quat salt is obtained as a white to slightly yellow solid, ≠95 g (48%).

Step 3

-continued

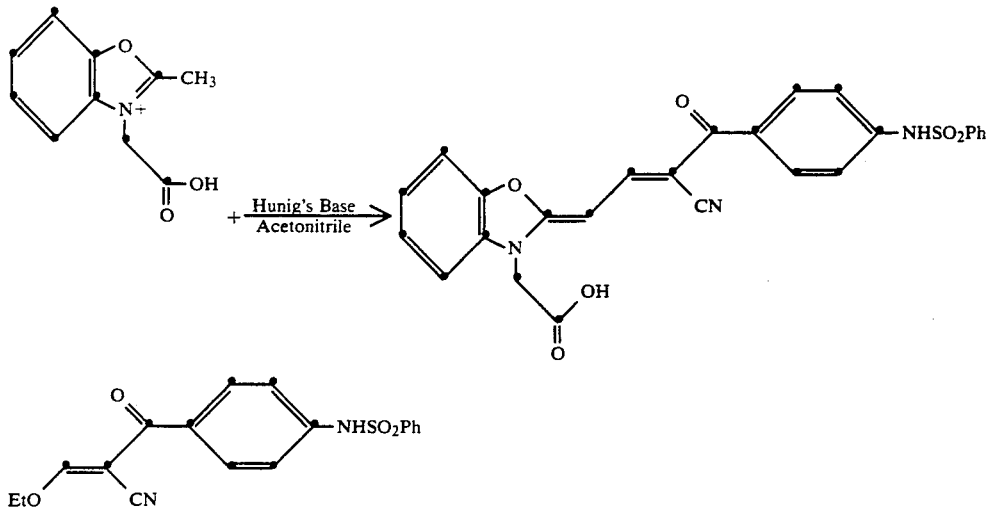

| | | |
|---|---|---|
| Benzoxazole quat salt | MW = 272 | 27.2 g (0.1 moles) |
| Ethoxyvinylbenzolacetonitrile | MW = 356 | 35.6 g (0.1 moles) |

Synthesis of the Blocking Group

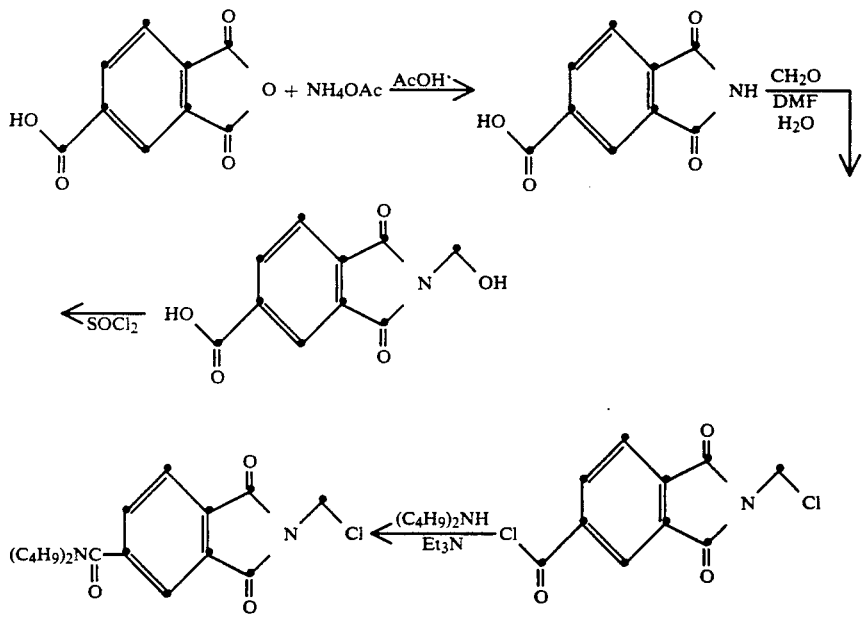

| | | |
|---|---|---|
| Diisipropylethylamine | MW = 129 | 12.9 g (0.1 moles) |
| Acetonitrile | | 100 mls |

Procedure

The benzoxazole quat salt (27.2 g) and the ethoxyvinylbenzoylacetonitrile (35.6 g) were suspended in 100 ml of dry acetonitrile (dried over 4A sieves). Diisopropylethylamine is added to the reaction mixture. and an immediate color change is noted. The reaction mixture was heated on an oil bath for about 1.5 hours at reflux. Upon cooling to room temperature, the deposited brown-orange solid is collected by filtration. The filter cake was washed with 20 ml of acetonitrile and 100 ml of diethyl ether. If desired, the product may be further purified by slurrying in warm acetone, but the material obtained after the ether wash is sufficiently pure for further reaction.

Trimilletic anhydride (2.6 mol) and ammonium acetate (2.6 mol) and 2.5 1 of glacial acetic acid were refluxed under nitrogen for 12 h. The reaction was reduced to ½ volume and cooled. A white solid was collected, washed with $H_2O$ and dried to give the desired phthalamide in 78% yield.

The 4-carboxyphthalimide (0.5 mol) was dissolved in dimethylformamide (200 ml) and $H_2O$ (600 ml) and treated with 37% aqueous formaldehyde (100 ml) and the mixture was heated on a steam bath until the solution became homogenous. The reaction was placed in an ice bath and cooled. A white solid crystallized and was collected and washed with cold water. The solid was dissolved in THF and dried with $MgSO_4$ and concentrated to yield 96% of hydroxymethylphthalimide product.

The N-hydroxymethyl-4-carboxyphthalimide (0.1 mol) was treated with thionyl chloride (80 ml) and stirred at RT for 3 h and heated at reflux for 15 h. The reaction was concentrated to a thick oil and dissolved in dichloromethane and concentrated again to a solid. This material was washed with cyclohexane to give the N-chloromethylphthalimide-4-carboxychloride in 85% yield.

The N-chloromethylphthalimide-4-carboxychloride (0.1 mol) was dissolved in dichloromethane and added dropwise to a solution of dibutyl amine (0.1 mol) and triethylamine (0.1 mol) in tetrahydrofuran (100 ml) at 0° C. under nitrogen. The reaction was stirred at 0° C. for 3 h and concentrated to dryness. The residue was dissolved in diethyl ether and filtered and the solution was concentrated. The product is either chromatographed or recrystallized from acetonitrile depending on its solubility.

Synthesis of Blocked Filter Dye

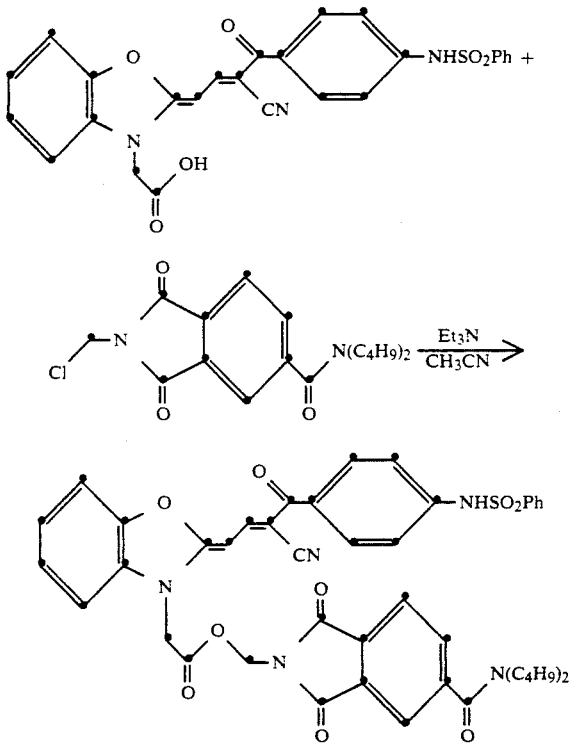

| | | |
|---|---|---|
| Meroxyanine | MW = 501 | 5.0 g (0.01 mol) |
| Chloromethyl Phthalimide | MW = 406.8 | 4.1 g (0.01 mol) |
| Triethylamine | | 1.1 g |
| Acetonitrile | | 50 mls |

Procedure

The merocyanine dye (5.0 g) and the chloromethylphthalimide (4.1 g) were suspended in 50 mls of dry acetonitrile. Triethlamine (1.1 g) was added and the mixture heated on an oil bath at 60° C. for 4 hours. After the heating period, the mixture is cooled to room temperature and the solvent removed by rotary evaporation. The tarry residue was taken up in a minimum of ethyl acetate and deposited atop a fast filtration column of silica gel. The column was eluted with methylene chloride (again under water aspirator pressure) until the eluent takes on a slight yellow color. This process removes the unreacted blocking group. At this point ethyl acetate is used to elute the desired blocked dye. Unreacted carboxymerocyananine is immobile on the column with both methylene chloride and ethyl acetate as eluent. The combined ethyl acetate fractions were evaporated under reduced pressure, with the water bath kept below 40° C. As concentration is effected, yellow crystals are deposited.

Evaluation of Filter Dye Performance

Phthalimidomethyl blocked yellow filter dyes were evaluated in two formats: (1) single layer gel coatings of oil dispersions of the dyes, and (2) three-layer light sensitive coatings comprised of an oil dispersion of dye in the interlayer between blue-sensitive and green-sensitive imaging layers. The single layer coatings were used in evaluating the dye spectra, the wandering tendency and stability during keeping and the washout efficiency during processing. The trilayer coatings were used in evaluating the sensitometric effects of the filter dye.

EXAMPLE 2

Evaluation of a single layer coating

The filter dye 1 was dispersed in twice its weight of N,N-diethyllauramide and 3.75 times its weight of gelatin and then coated on a cellulose acetate support at a level of 0.43 g/m$^2$ of dye.

The filter dye layer was overcoated with 1.08 g/m$^2$ of gelatin. The coating was hardened with bisvinyl sulfonyl methyl ether (1.55% of total gel laydown). The coating was subsequently subjected to several treatments (described below) and spectra of the treated films (after drying if necessary) were measured to assess the effect of each treatment.

a) A five-minute distilled water wash at 38° C. was carried out to examine the mobility of filter dye 1 under non-hydrolytic conditions. No loss in dye density was observed following the wash, suggesting that the dye has little or no mobility in its ballasted form.

b) A fresh coating was also put through the E6 reversal process described in *The British Journal of Photography Annual,* 1977, pages 194–7 to determine the extent of dye removal. The film was completely decolorized, suggesting that the dye was completely removed.

c) Coatings were held at 49° C./50% relative humidity for one week to simulate long term keeping These incubated films were then subjected to the five-minute 38° C. water wash or E6 process as described above. The results showed that the incubation has little effect on the film and the dyes have good keeping properties but can be completely removed on processing.

Table I summaries the results of testing of single layer coatings of filter dye 1.

Filter Dye 1 has the structure:

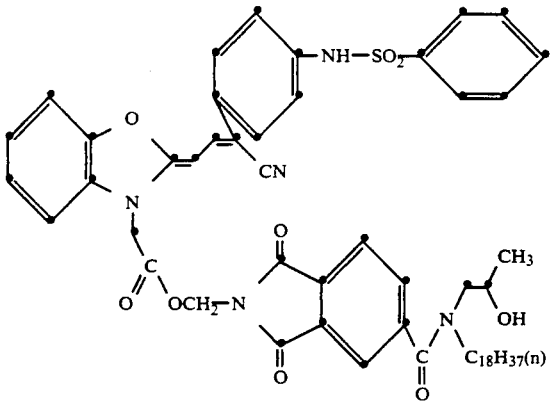

TABLE I

Evaluation of Filter Dye 1

| Treatment | Density at 458 nm |
|---|---|
| 1) none | 1.57 |
| 2) 5', 38° C. $H_2O$ wash | 1.59 |
| 3) E6 Process | 0.07 |
| 4) 1 week incubation at 49° C./50% RH (No solution treatment) | 1.43 |
| 5) As treatment #4, followed by 5', 38° C. $H_2O$ wash | 1.43 |
| 6) As treatment #4, followed by E6 Process | 0.10 |

EXAMPLE 3

Evaluation of a multilayer coating

The filter dye 1 was coated in a trilayer coating structure as an interlayer between a top blue-sensitive silver halide emulsion layer and a bottom green-sensitive silver halide emulsion layer. The interlayer contained 0.32 g/m$^2$ of the filter dye dispersed in 0.64 g/m$^2$ of N,N-diethyllauramide and 1.61g/m$^2$ of gelatin. For comparison, another trilayer coating was prepared with an interlayer containing 0.16 g/m$^2$ of the anionic dye AD-1 (see below) mordanted by the cationic polymer A 0.19 g/m$^2$ and 1.61 g/m$^2$ of gelatin. The mordanted dye AD-1 represents a conventional approach to the way filter dyes previously have been used.

A trilayer coating which contained only gelatin in the interlayer (1.61 g/m$^2$) was also prepared for comparison purposes.

The blue-sensitive imaging layer in the above coatings contained a blend of two silver bromoiodide emulsion chemically sensitized with sulfur plus gold. One emulsion was spectrally sensitized with SD-1 and the other with SD-2. The blue layer also contained the yellow coupler C-1. The green-sensitive imaging layer contained a silver bromoiodide emulsion chemically sensitized with sulfur plus gold and spectrally sensitized with a pair of dyes, SD-4 and SD-3. The green layer contained the magenta coupler C-2.

These compounds used in these coatings are identified as follows

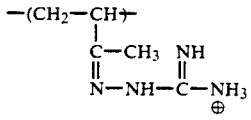

Polymer A

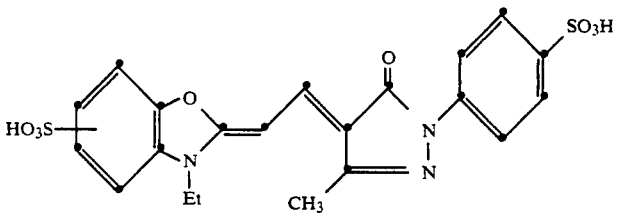

AD-1

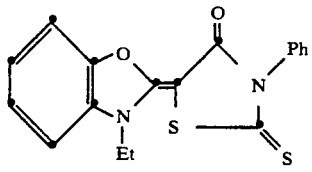

SD-1

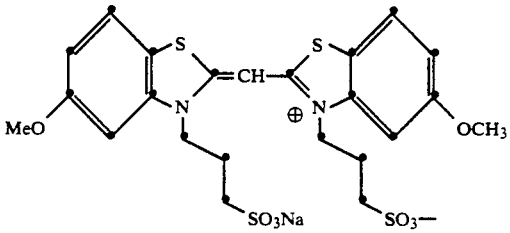

SD-2

-continued

SD-3

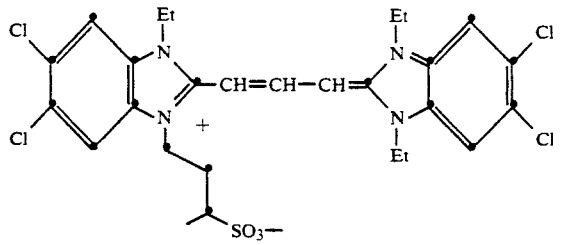

SD-4

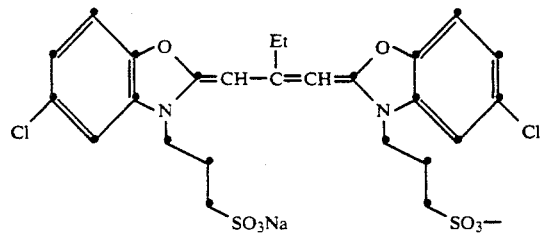

C-1

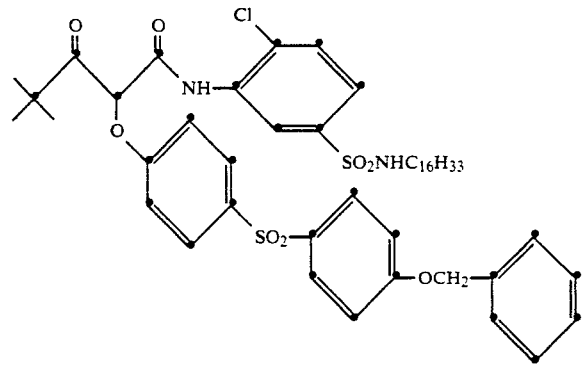

C-2

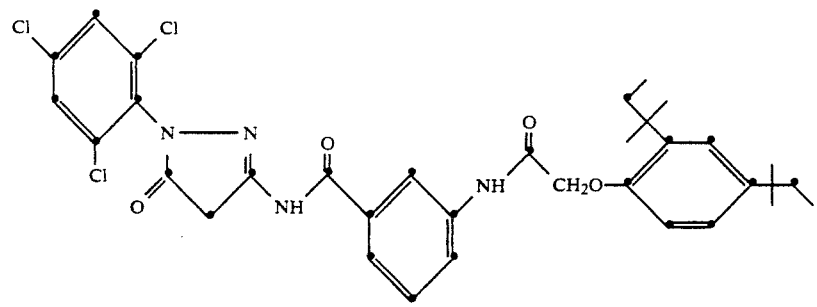

These coatings were given sensitometric exposures to asses the effect of filtration on blue and green speed. Exposure was for 0.010 second through a 0–3.0 density step tablet (0.15 density steps) to a tungsten light source on a Macbeth IB sensitometer equipped with a DL5 filter (daylight simulation) and the appropriate spectral filter for selective transmission of blue or green light. For the blue exposure a Wratten 98 filter was used; for green exposure a Wratten 12 filter was used. Following exposure, the coating was either processed immediately using the E6 processing identified above, or incubated for seven days at 49° C./50% RH and subsequently processed in the E6 process. The reversal speeds were measured at a value of 0.5 density units below the maximum density. Table II gives a summary of the fresh and incubated sensitometry.

TABLE II

Summary of Trilayer Evaluation of Filter Dyes 1 & AD-1

| | Fresh Speed | | Incubated Speed | |
|---|---|---|---|---|
| Filter Dye | Blue | Green | Blue | Green |
| none (gel only) | 208 | 187 | 189 | 179 |
| AD-1 (comparison) | 187 | 185 | 173 | 176 |
| Filter Dye 1 (invention) | 197 | 181 | 183 | 173 |

Filter dye 1 causes significantly lower blue speed losses than the mordanted anionic dye AD-1, indicating a significantly lower wandering tendency for dye 1. Green speeds were virtually unaffected by the presence of either filter dye.

The invention has been described in detail with particular reference to preferred embodiments thereof, but it will be understood that variations and modifications can be effected within the spirit and scope of the invention.

What is claimed is:

1. A photographic element comprising a support bearing a silver halide emulsion layer and an associated dye forming coupler and an immobile filter dye having a ballast group which is removable from the remainder of the dye during processing at a pH of 10 to 12; wherein the filter dye is represented by the structure;

DYE—LS—BAL wherein:

BAL is a ballast group;

DYE is a filter dye moiety;

LS is a splittable linking group attached to a position in DYE that is not in conjugation with the dye chromophore; and splitting of the linking group involves one of the following reactions;

a) Hydrolysis of a phthalimidomethyl ester:

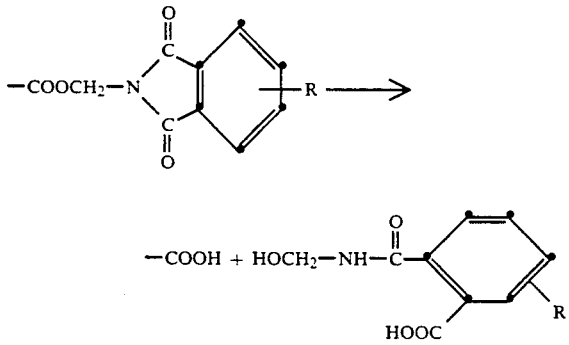

b) Hydrolysis of a keto ester:

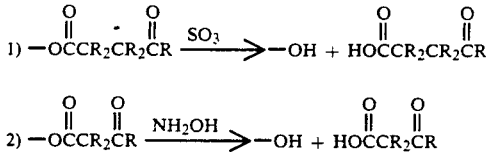

c) Oxidative cleavage of a diketone:

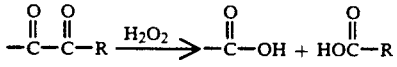

d) Hydrolysis of a ketal or acetal:

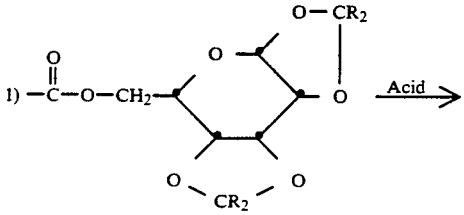

-continued

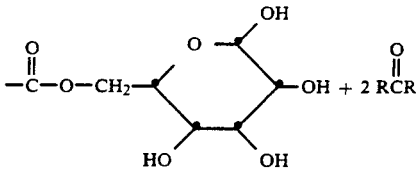

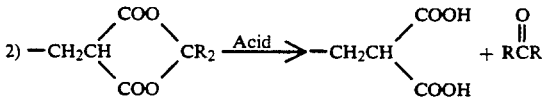

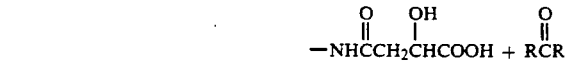

e) Hydrolysis following oxidation:

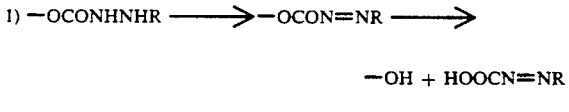

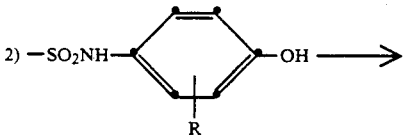

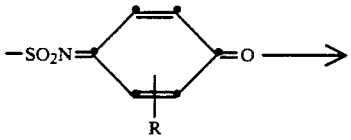

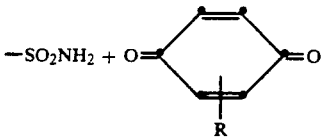

f) Fluoride-catalyzed siloxy bond cleavage:

13 $OSiR_3$—⟶—OH+$HOSiR_3$;

g) Anchimerically assisted base-catalyzed hydrolysis:

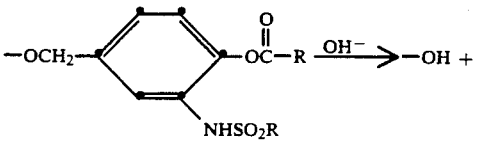

-continued

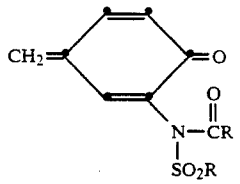

wherein R is hydrogen or one or more substituents, at least one of which is BAL.

2. A photographic element of claim 1 wherein the filter dye is in the silver halide emulsion layer.

3. A photographic element of claim 1 wherein the filter dye is in a separate filter layer that does not contain a silver halide emulsion.

4. A photographic element of claim 3 which contains two or more silver halide emulsion layers wherein a first silver halide emulsion layer is furtherest from the support and is sensitive to light in the blue region of the spectrum and at least one second silver halide emulsion layer is between the support and the first silver halide emulsion layer and is sensitized to radiation of longer wavelength wherein the filter layer is positioned between the first and second silver halide emulsion layers.

5. A photographic element of claim 3 containing a first silver halide emulsion layer sensitized to one region of the visible spectrum and a second silver halide emulsion layer sensitized to a different region of the spectrum wherein the filter layer is positioned between the first and second silver halide emulsion layer and contains a filter dye that absorbs radiation to which the first silver halide emulsion layer is sensitive.

6. A photographic element of claim 1 wherein after processing to form a dye image, there is less than 0.1 units of density attributable to the filter dye.

7. A photographic element of claim 1, wherein DYE is an azo dye, an arylidene dye, a cyanine dye or a merocyanine dye.

8. A photographic element comprising a support bearing a silver halide emulsion layer and an immobile filter dye having a ballast group which is removable from the remainder of the dye during processing at a pH of 10 to 12;

wherein the filter dye has the structure

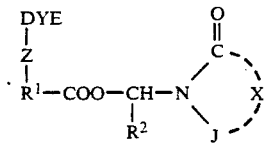

where:

DYE is a filter dye moiety;

Z is O, S or a nitrogen of a heterocyclic ring;

$R^1$ is alkylene of 1 to 10 carbon atoms or arylidene of 6 to 16 carbon atoms;

$R^2$ is hydrogen, alkyl of 1 to 4 carbon atoms of aryl of 6 to 12 carbon atoms;

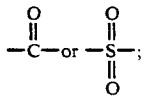

X represents the atoms to complete a 5- to 6- membered ring or ring system moiety.

9. A photographic element of claim 8 wherein the filter dye has the structure

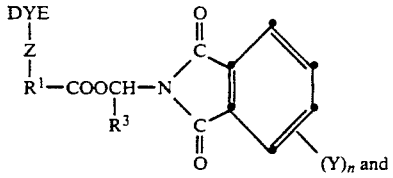

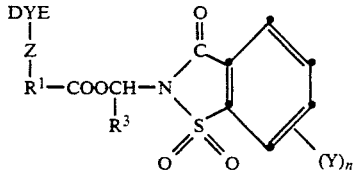

wherein $R^3$ is hydrogen or alkyl of 1 to 4 carbon atoms;

n is 0 to 3; and

Y is a substituent.

10. A photographic element of claim 1 designed for reversal processing.

11. A process of forming an image in a photographic element of anyone of claims 1 or 8, comprising the steps of non-chromogenic development followed by color development, wherein the filter dye is washed out of the element during one or more of the processing steps.

* * * * *

UNITED STATES PATENT AND TRADEMARK OFFICE

CERTIFICATE OF CORRECTION

PATENT NO. : 5,158,865

DATED : October 27, 1992

INVENTOR(S) : J.W. Harder et al

It is certified that error appears in the above-indentified patent and that said Letters Patent is hereby corrected as shown below:

Column 27, line 45 should read:

$$1)\quad -\overset{O}{\overset{\|}{O}}CCR_2CR_2\overset{O}{\overset{\|}{C}}R \xrightarrow{SO_3^{\ominus}} -OE + HO\overset{O}{\overset{\|}{C}}CR_2CR_2\overset{O}{\overset{\|}{C}}R$$

Column 28, line 56 should read:

$$-OSiR_3 \longrightarrow -OE + HOSiR_3$$

Column 30, line 16 should read $$J \text{ is } -\overset{O}{\overset{\|}{C}}- \text{ or } -\underset{\underset{O}{\|}}{\overset{O}{\overset{\|}{S}}}- \text{ ; and}$$

Signed and Sealed this

Fourteenth Day of December, 1993

*Attest:*

*Attesting Officer*

Bruce Lehman

BRUCE LEHMAN

*Commissioner of Patents and Trademarks*